United States Patent [19]

Kashimura et al.

[11] Patent Number: 4,939,322

[45] Date of Patent: Jul. 3, 1990

[54] PUFFER TYPE CIRCUIT BREAKER

[75] Inventors: Katsuichi Kashimura, Takahagi; Minori Sato, Hitachi; Osamu Koyanagi, Hitachi; Yukio Kurosawa, Hitachi, all of Japan

[73] Assignee: Hitachi, Ltd., Tokyo, Japan

[21] Appl. No.: 326,652

[22] Filed: Mar. 21, 1989

[30] Foreign Application Priority Data

Mar. 25, 1988 [JP] Japan ..... 63-69855

[51] Int. Cl.[5] ..... H01H 33/88

[52] U.S. Cl. ..... 200/148 A; 200/148 R

[58] Field of Search ..... 200/148 A, 148 R

[56] References Cited

U.S. PATENT DOCUMENTS

| | | | |
|---|---|---|---|
| 4,342,890 | 8/1982 | Graf | 200/148 A |
| 4,371,765 | 2/1983 | Ragaller | 200/148 A |
| 4,565,911 | 1/1986 | Slamecka | 200/148 A |

*Primary Examiner*—Robert S. Macon

*Attorney, Agent, or Firm*—Antonelli, Terry, Stout & Kraus

[57] ABSTRACT

The present invention relates to a puffer type circuit breaker having a high voltage and large capacity, which is provided with an insulating nozzle for blowing a arc-extinguishing gas of high pressure generated by separating a movable contactor from a fixed contactor. The fixed contactor has a larger diameter portion formed on the base portion thereof and a smaller diameter portion formed at the tip end thereof, and the insulating portion has a first throat portion adjusted by the smaller diameter portion and a second throat portion located at the downstream side of the first throat portion and adjusted by the larger diameter portion, thereby allowing the gas inlet portion to be formed by the diameter difference between the first throat portion and the smaller diameter portion which is in such manner that the second throat portion is adjusted by the larger diameter portion. By virtue of these features, when the contactors are separated from each other, even if the arc-extinguishing gas of high pressure flows into the space between the first throat portion and the second throat portion, the rapid gas flow is not generated therein. Accordingly, since the arc-extinguishing gas is prevented from lowering the gas density on the tip of the fixed contactor, it is possible to improve the breaking ability of small capacitive current.

8 Claims, 6 Drawing Sheets

PUFFER TYPE CIRCUIT BREAKER

FIELD OF THE INVENTION

The present invention relates to a puffer type circuit breaker, and more particularly to a puffer type circuit breaker having an insulating nozzle provided with a plurality of throat portions.

BACKGROUND OF THE INVENTION

A puffer type circuit breaker is generally provided with a gas compressor comprising a piston and a cylinder which is slidable relative to the piston, and with an insulating nozzle for effectively blowing an arc-extinguishing gas of high pressure obtained by means of the gas compressor onto an arc which may be generated when the contactors of the circuit breaker are separated from each others.

FIG. 8 shows an example of the puffer type circuit breakers of such type.

In FIG. 8, breaking portions enclosed within the circumference of an arc-extinguishing gas is shown and in this portion a gas compressor 8 is composed of a puffer cylinder 1 integrally formed with a shaft 6 connected to a not-shown operating device, and of a stationary piston 7 slidably engaging with the cylinder 1. A movable contactor 2 is mounted on the shaft 6, and an insulating nozzle 4 and an insulation cover 3 are secured to the puffer cylinder 1 by surrounding the movable contactor 2. The insulating nozzle 4 is formed with a single throat portion 4*a* corresponding to a nozzle through which a fixed contactor 11 is inserted, and the fixed contactor 11 is adapted to contact with the movable contactor 2. The fixed contactor 11 is adapted to contact with the movable contactor 2. The fixed contactor 11 has a larger diameter portion 11*b* of diameter $D_2$ on the base side thereof. In the closing state of the breaker, as shown in FIG. 8, the smaller diameter portion 11*a* of diameter $D_1$ on the tip thereof. In the closing state of the breaker, as shown in the FIG. 8, the larger diameter portion 11*b* is inserted at the distance $X_1$ from the throat portion 4*a* to the shown position. The throat portion 4*a* has an inner diameter $D_A$ slightly greater than the outer diameter $D_2$ of the larger diameter portion 11*b*.

When the shaft 6 is moved to the right direction by means of a not-shown operating device, the arc-extinguishing gas in the gas compressor 8 is compressed. In an initial stage of the compression, exhaust ports 10 of the shaft 6 for opening the central hollow portion of the shaft 6 to environment are closed by a closing member 7*a* occuring at the mounting base portion of the stationary piston 7, and the throat portion 4*a* of the insulating nozzle 4 is closed by the larger diameter portion 11*b* of the fixed contactor 11. After that, as disclosed in Japanese Patent Publication No. 56-12973 corresponding to U.S. Pat. No. 3,839,613, gas flows 21 and 22 passing through the hollow portion of the shaft 6 take place as shown in FIG. 9, and when the throat portion 4*a* is moved by a distance $X_1$ so as to reach the smaller diameter portion 11*a* as disclosed in Japanese Patent Publication No. 58-26133, gas flows 25 and 26 passing through the throat portion 4*a* take place also as shown in FIG. 9, thereby allowing the arc which has been generated by separating both contactors 2 and 11 from each other to be extinguished by blowing those gas flows.

However, the breaking ability of small capacitive current is noted to the effect that at the time when the distance between the both contactors 2 and 11 is relatively small, an electric current is broken, and after that, a high voltage is generated between the contactors. In FIG. 8, after the throat portion 4*a* is moved so as to go through the larger diameter portion 11*b* of the fixed contactor 11, a gas flow take place so as to discharge a gas through the gas between the throat portion 4*a* and the smaller diameter portion 11*a*, thereby allowing the gas pressure in the neighborhood of the tip of the fixed contactor 11 to be lowered. Accordingly, a dielectric strength between the facing portions of both contactors 2 and 11 are deteriorated to lower the breaking ability of small capacitive current.

In connection with the abovementioned matters, a puffer type circuit breaker disclosed in Japanese Patent Application Laid-Open No. 59-103238 is shown in FIG. 10. The members and portions corresponding to those shown in FIG. 8 are denoted with the same reference numbers. The only differences between the apparatuses shown in FIGS. 8 and 10 will be described as follows.

In the fixed contactor 11, a blocking plate such as a disk is mounted on the base portion thereof, and a second throat portion is defined by the blocking plate 4 and the inner surface of a straight cylindrical portion 4*b* formed in the downstream portion of the insulating nozzle 4.

In this structure, since it prevents the reduction of the gas pressure on the tip of the fixed contactor 11 to provide with the blocking plate 9, it is intended to improve the breaking ability of small capacitive current in such manner as to generate a high voltage between both contactors when the distance between both contactors 2 and 11 is not fully provided by separation of those contactors.

In this puffer type circuit breaker, however, the inner diameter of the first throat portion 4*a* formed in the upstream side of a blowing gas is equal to the outer diameter of the fixed contactor 11. Therefore, when the blocking plate 9 is moving along the inner surface of the straight cylindrical portion 4*b* in the insulating nozzle 4 as the both contactors 2 and 11 are separated from each other, the volume of a chamber defined by the fixed contactor 11 and the blocking plate 9 increases rapidly, thereby allowing the chamber to be under a negative pressure. Thus, the tip of the fixed contactor 11 passes through the first throat portion 4*a*, and the arc-extinguishing gas rapidly flows into the negative-pressured chamber as abovementioned via the tip of the fixed contactor 11 from the gas compressor 8. In this manner, since the pressure or density of the gas on the tip of the fixed contactor 11 is lowered, it is impossible to improve the breaking ability of small capacitive current.

SUMMARY OF THE INVENTION

It is, accordingly, an object of the present invention is to provide a puffer type circuit breaker which has an improved breaking ability of small capacitive current.

The foregoing object is accomplished by providing a puffer type circuit breaker comprising a fixed contactor having a larger diameter portion in the base portion side thereof and a smaller diameter portion in the tip thereof, an insulating nozzle having a first throat portion adjusted by the smaller diameter portion and a second throat portion positioned at the downstream side of the blowing gas further than that of the first throat portion and adjusted by the larger diameter portion, and a inlet portion of an arc-extinguishing gas which is formed by the diameter difference between the smaller diameter portion and the first throat portion during adjusting of the second throat portion with the larger diameter portion.

In a puffer type circuit breaker according to the present invention as abovementioned, when the first throat portion does not pass through the smaller diameter portion of the fixed contactor yet, the arc-extinguishing gas of high pressure flows into the space between the first and second throat portions within the insulating nozzle through the inlet portion of the arc-extinguishing gas between the smaller diameter portion and the first throat portion. Accordingly, even if the first throat portion passes through the smaller diameter portion of the fixed contactor, the gas flow does not rapidly generate toward the space between the first and second throat portions as conventionally generated. This results in that the density of the arc-extinguishing gas does not lower on the tip of the fixed contactor, and it is possible to improve a breaking ability of small capacitive current.

DESCRIPTION OF THE PREFERRED EMBODIMENT

Figure 1:
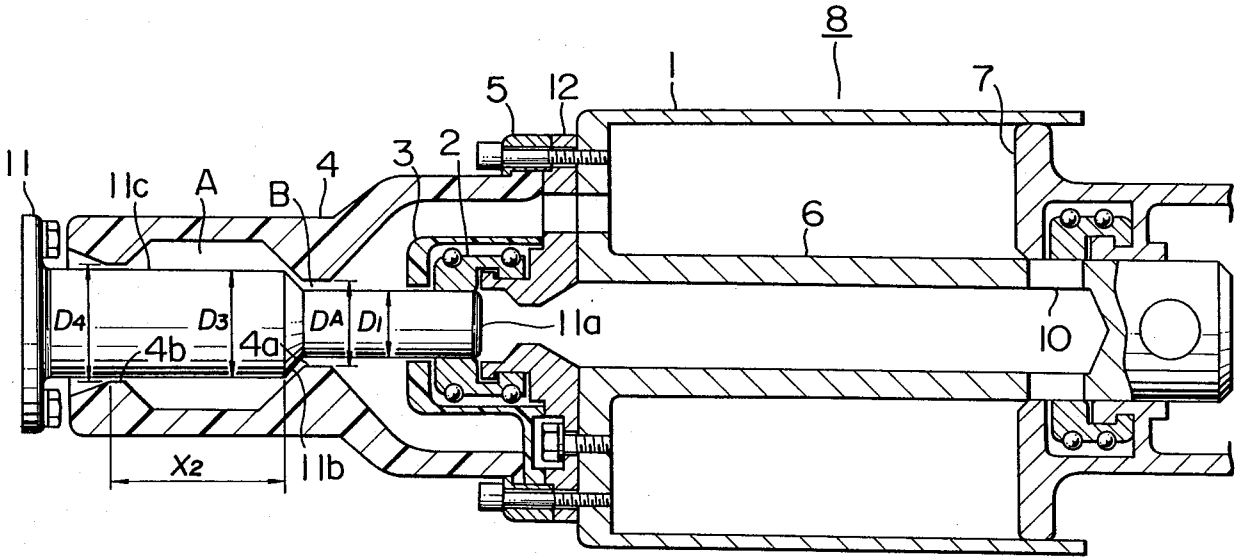
FIG. 1 is cross section of a puffer type circuit breaker, which is in a closed state, in accordance with an embodiment of the present invention.

The embodiment of the present invention will be described in detail by referring to the drawings.

FIG. 1 shows a puffer type circuit breaker in such manner that the breaker is substantially closed.

The shaft 6 located at the center of a puffer cylinder 1 as shown in FIG. 1 is connected with an operating device which is not shown. The fixed piston 7 is fitted slidably in the space between the inner surface of the puffer cylinder 1 and the outer surface of the shaft 6, thereby allowing a puffer chamber to be formed as a space. The arc-extinguishing gas within the space denoted as a puffer chamber is compressed by driving the shaft 6 in the right direction or the opening direction of the breaker. Thus, the gas compressor 8 is composed of these members and those operations. In the left-end surface of the puffer cylinder 1, a movable contactor 2 mounted to the mounting pedestal 12, an insulating cover 3 enclosing the movable contactor 2, and an insulating nozzle 4 enclosing the insulating cover 3 are secured thereto by a set fitting 5. In the insulating nozzle 4, there are provided with a first throat portion **4*a* formed at the upstream side of the blowing gas adjacent to the movable contactor 2 and a second throat portion 4*b* formed at the downstream side of the blowing gas. The inner surface of an insulating nozzle 4 located between the both throat portions 4*a* and 4*b* is recessed, thereby allowing a space A to be formed. The diameter $D^A$ of the first throat portion 4*a* is smaller than the diameter $D_4$ of the second throat portion 4*b***.

The fixed contactor 11 facing to the movable contactor 2 has a smaller diameter portion **11*a* at the tip thereof, a larger diameter portion 11*c* at the base portion thereof, and a gradually changing diameter portion 11*b* between a smaller diameter portion 11*a* and a larger diameter portion 11*c*. The smaller diameter portion 11*a* has the diameter $D_1$ smaller than the diameter $D^A$ of the first throat portion 4*a* and contacts with the movable contactor 2. The larger diameter portion 11*c* has the diameter $D_3$ larger than the diameter $D^A$ of the first throat portion 4*a* and the diameter $D_l$ of the smaller diameter portion 11*a* and is equal nearly to the diameter $D_4$ of the second throat portion 4*b***.

In the closed state as shown in FIG. 1, the second throat portion **4*b* penetrates into the larger diameter portion 11*c* of the fixed contactor 11 by the fitting size $X_2$. Accordingly, the second throat portion 4*b* is substantially closed by the larger diameter portion 11*c*, while the smaller diameter portion 11*a* is inserted into the first throat portion 4*a*. Then, the inlet portion B of the arc-extinguishing gas which communicates with the gas compressor 8 and the space A is formed by the diameter difference between the first throat portion 4*a* and the smaller diameter portion 11*a***.

The breaking operation of the breaker will be described as follows.

Figure 2:
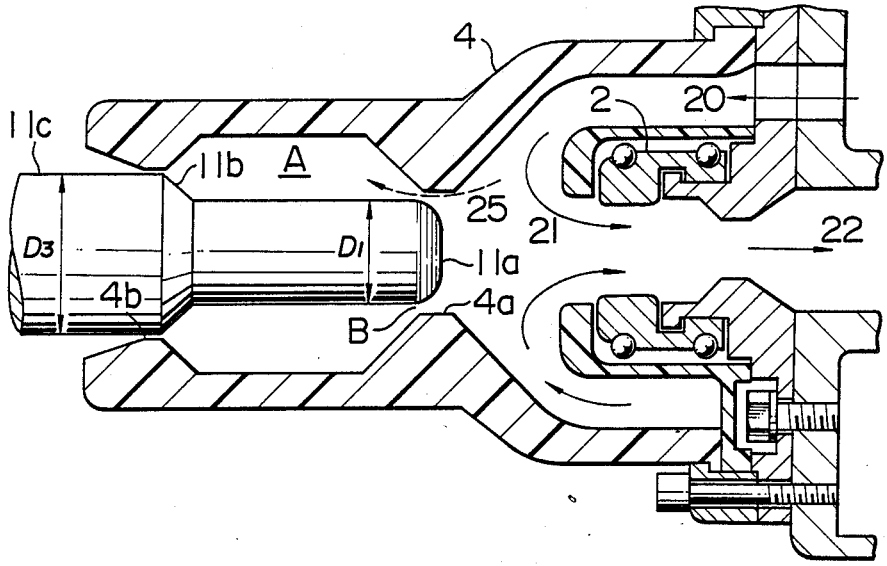
FIG. 2 is an enlarged partial view of the breaker, which is opened half-way, of FIG. 1.

When the shaft 6 is driven in the right direction by the operating device (not shown), the space between both contactors 2 and 11 is increased to reach the state shown in FIG. 2 as the arc-extinguishing gas is compressed in the gas compressor 8. Since the smaller diameter portion **11*a* moves through the first throat portion 4*a* from the time when the breaking operation starts to the time when it reaches to the state shown in FIG. 2, the arc-extinguishing gas supplied from the gas compressor 8 of high pressure is conducted into the space A through the gas inlet portion B formed between the first throat portion 4*a* and the smaller diameter portion 11*a* as shown with a arrow 25. On the other hand, the second throat portion 4*b* is substantially closed by the larger diameter portion 11*c*. Therefore, the pressure practically equal to that of the space between the contactors 2 and 11** is maintained in the space A.

Figure 4:
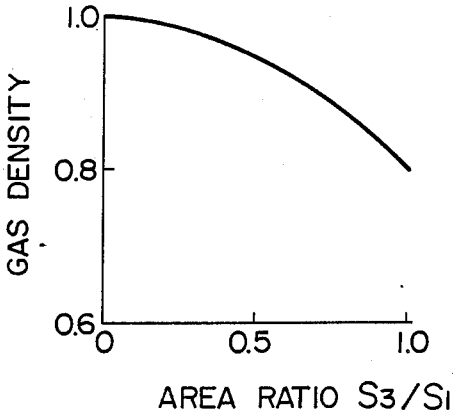
FIG. 4 is a characteristic diagram of the gas density on the tip, of the fixed contactor.

In the puffer type circuit breaker including the fixed contactor 11 having a single diameter in the length direction and no second throat portion **4*b*, when the first throat portion 4*a* passes through the tip of the fixed contactor 11 as shown in FIG. 2, the rapid flow of the arc-extinguishing gas is generated in such manner as to be discharged from the first throat portion 4*a*, thereby allowing the gas pressure to be lowered on the tip of the fixed contactor 11. Therefore, since the gas density is lowered on the tip of the contactor 11, the transient withstand voltage is lowered also. On the other hand, in the structure of FIG. 2, there is provided with the second throat portion 4*b*, which is practically closed by the smaller diameter portion 11c. The advantageous effect obtainable from this structure will be described on the basis of the diagram shown in FIG. 4 as follows. FIG. 4 shows the density characteristic of the arc-extinguishing gas on the tip of the fixed contactor 11 wherein the ratio $S_3/S_1$ of the area $S_1$ of the gas inlet portion formed between the first throat portion 4a and the smaller diameter portion 11a to the area $S_3$ of the discharging portion formed by the second throat portion 4b and the larger diameter portion 11c is shown by using as a parameter. It will be seen from FIG. 4 that, if the ratio of the area is zero, that is to say, the gas flow is not practically formed by eliminating the area for discharging the gas and defined between the second throat portion 4b and the larger diameter portion 11c, the gas density is not lowered on the tip of the fixed contactor 11, and also the gas density on the tip of the fixed contactor 11** is maintained in the better manner if the area ratio is less than 1.0.

Consequently, in the case of breaking small capacitive current so that an arc between the contactors as shown in FIG. 2 is extinguished and the high recovery voltage is applied between the contactors 2 and 11, the gas density on the tip of the fixed contactor 11 increases so as to be able to improve the transient withstand voltage. Furthermore, the volume of the space A increases as the breaking operation is advancing, while the second throat portion 4b is closed. Thus, since the gas flow 25 which moves from the first throat portion 4a into the space A does not practically generate, it is not generated almost to lower the gas density on the tip of the fixed contactor 11.

Figure 3:
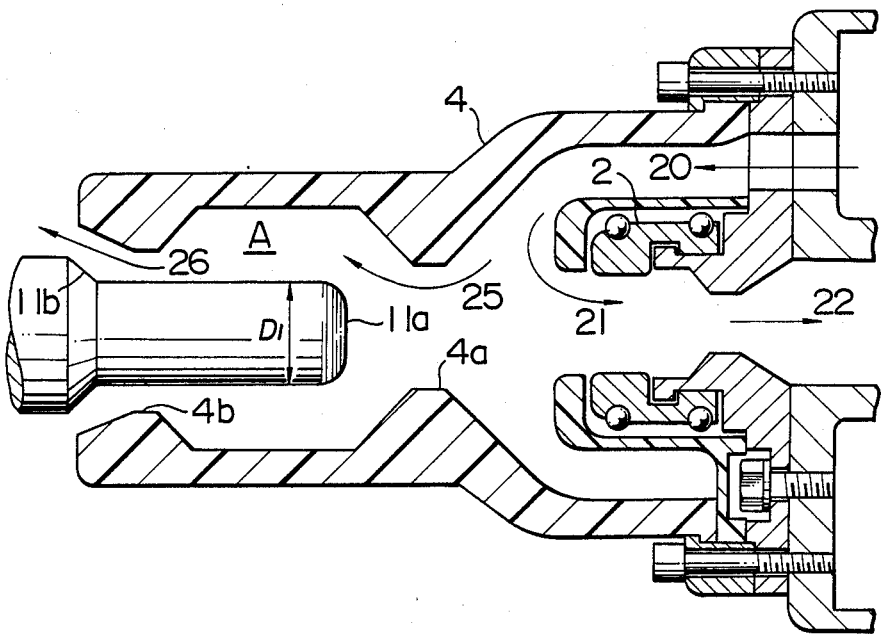
FIG. 3 is an enlarged partial view of the breaker, which substantially finishes its opening, of FIG. 1.

Further, when the breaking operation is advanced to the manner shown in FIG. 3, the second throat portion 4b passes through the larger diameter portion llc. At this time, although the gas flow is generated as shown with arrows 25 and 26, the area for discharging the gas flow 26 gradually increases and is designed so as not to generate the rapid change of the gas density in order that there is provided with the portion 11b having a gradually changing diameter in the fixed contactor 11. Then, the gas density on the tip of the fixed contactor 11 is lowered by the gas flow 25, while since at this time the distance between the contactors 2 and 11 is fully produced by separating those, an electrical field strength is remarkably reduced, thereby allowing the high transient withstand voltage to be obtained therefrom. In this state, the cross-sectional area $S_2$ formed at the first throat portion 4a and the annular cross-sectional area $S_4$ formed at the second throat portion 4b are as follows:

$$S_2=\pi D_A^2/4 \quad (1)$$

$$S_4=\pi(D_4^2-D_1^2)/4 \quad (2)$$

The dimentions of various structural members are determined to satisfy the relation of "$S_4 \geqq S_2$". Consequently, in the breaking case of a heavy short electric current, a strong gas flow 25 and 26 can be obtained from the first throat portion 4a, which serves as a nozzle, without being choked or disturbed by the gradually changing diameter portion 11b.

Figure 5:
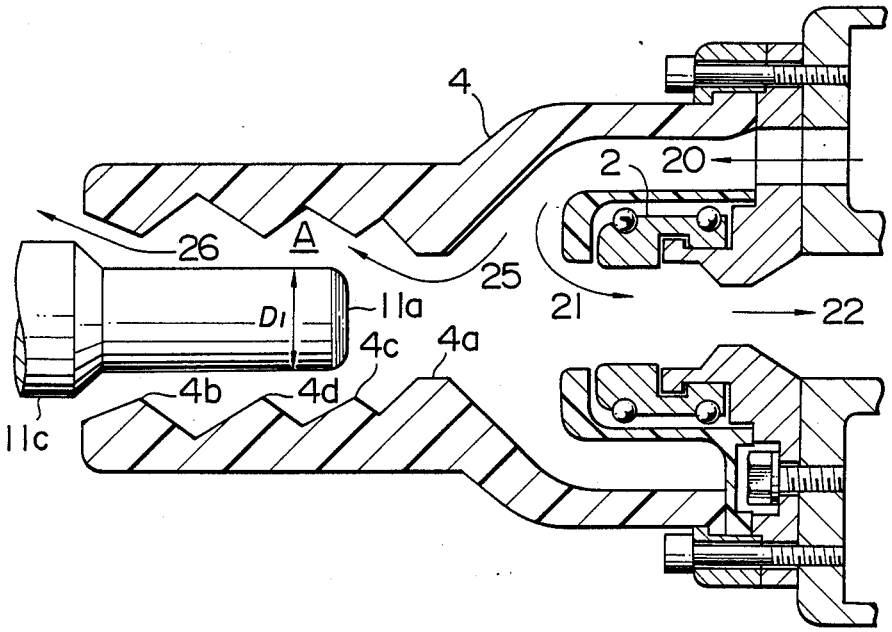
FIG. 5 is a cross section of a puffer type circuit breaker, which is opened halfway, in accordance with another embodiment of the present invention.

FIG. 5 shows a circumferential portion of the insulating nozzle 4 of the puffer type circuit breaker in accordance with other embodiment of the present invention. The following description is directed only to this insulating nozzle 4. In this example, two projections 4c and 4d are formed at the space between the first throat portion 4a positioned at the side of the movable contactor 2 and the second throat portion 4b positioned at the downstream side of the blowing gas. In this form, there is formed at least one surface for preventing the gas flow from straightly advancing as the gas is discharged and expanding from the first throat portion 4a. The gas flow colliding with this surface is deflected so as to leave toward the neighborhood of the tip of the fixed contactor 11, thereby preventing the gas density on the tip of the fixed contactor 11 from lowering.

In this embodiment, since the diameter of each projection 4c, 4d is made as one larger than that of the smaller diameter portion 11a of the fixed contactor 11 and the arc-extinguishing gas of high pressure is adapted to already flow into the space A before the larger diameter portion 11c passes through the second throat portion 4b, the rapid gas flow is not formed at the time when the smaller diameter portion 11a passes through the first throat portion 4a, thereby preventing the gas density from lowering on the tip of the fixed contactor 11 and thereby improving the transient withstand voltage.

Figure 6:
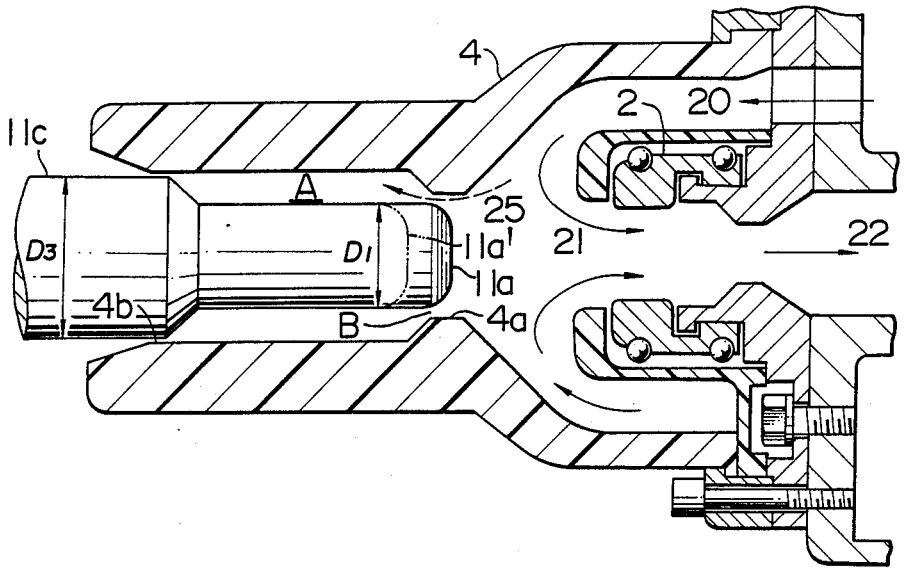
FIG. 6 is a cross section of a puffer type circuit breaker, which is opened halfway, in accordance with a further embodiment of the present invention.
Figure 7:
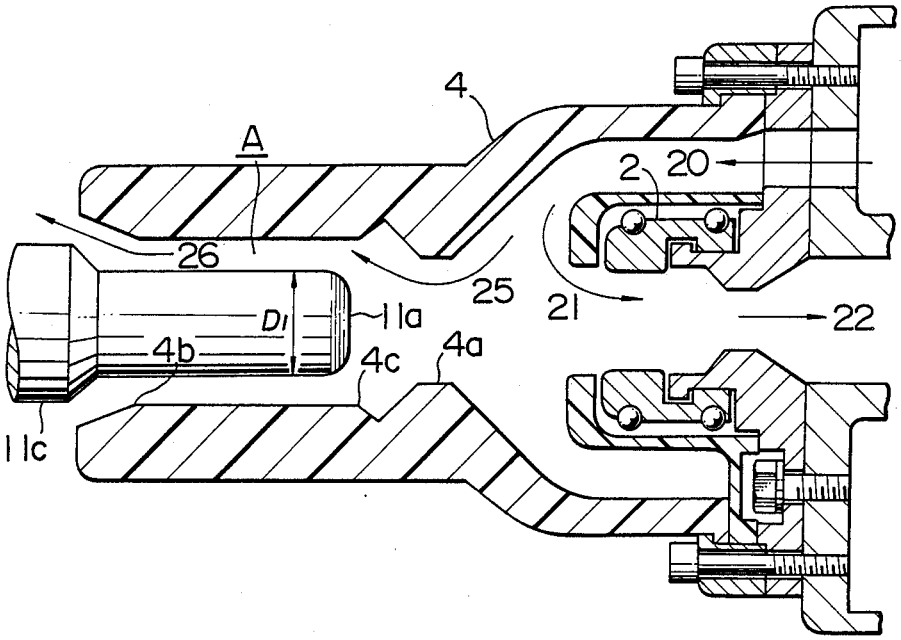
FIG. 7 is a cross section of a puffer type circuit breaker, which is opened halfway, in accordance with still another embodiment of the present invention.
Figure 8:
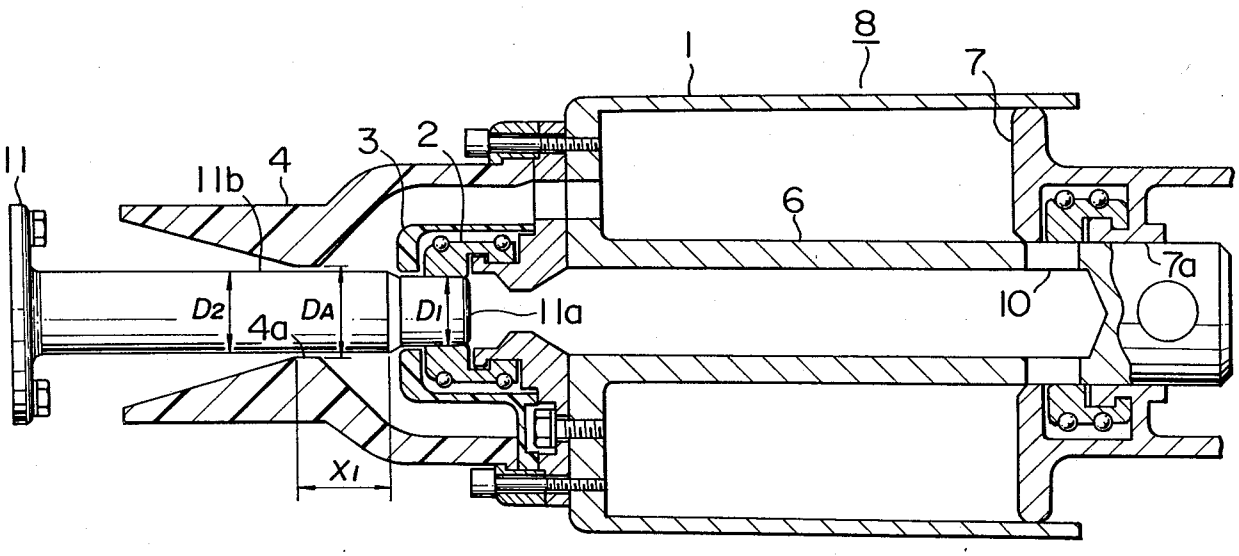
FIG. 8 PRIOR ART
FIG. 8 is cross section of a puffer type circuit breaker, which is closed, in accordance with a prior art.
Figure 9:
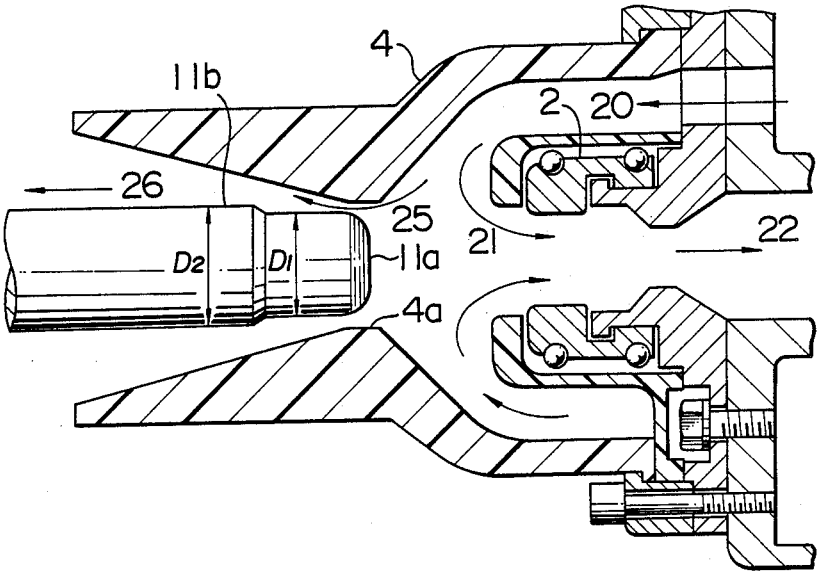
FIG. 9 PRIOR ART
FIG. 9 is an enlarged partial view of the breaker, which is opened halfway, of FIG. 8.
Figure 10:
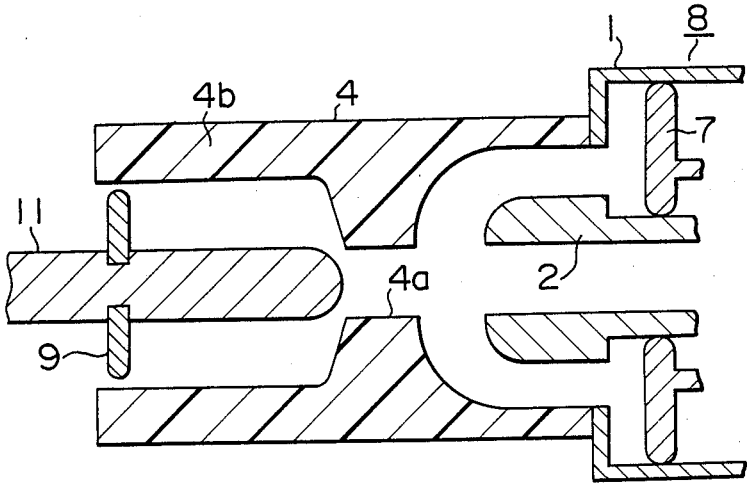
FIG. 10 PRIOR ART
FIG. 10 is a cross section of other puffer type circuit breaker, which is opened halfway, in accordance with a prior art.

Further, the puffer type circuit breaker in accordance with another embodiment of the present invention is shown in FIGS. 6 and 7, and the insulating nozzle 4 therein will be described as follows.

The insulating nozzle 4 shown in FIG. 6 has a second throat portion 4b formed at the enlarged diameter portion just adjacent to the first throat portion 4a located on the side of the movable contactor 2. The inner diameter of the second throat portion 4b is formed so as to be equal nearly to the diameter $D_3$ of the larger diameter portion 11c of the fixed contactor 11. Then, the length of the second throat portion 4b is suitably determined in such manner as to correspond to the distance between the gradually changing diameter portion and the tip of the fixed contactor 11, wherein the diameter difference between the first throat portion 4a and the smaller diameter portion 11a forms the gas inlet portion B which serves to communicate the gas compressor 8 with the space A formed between the second throat portion 4b and the smaller diameter portion 11a in the movable contactor 2 contacts with the fixed contactor 11, and the tip end of the smaller diameter portion 11a reaches to the first throat portion 4a just before the tip of the smaller diameter portion 11a is separated from the larger diameter portion 11c of the second throat portion 4b, to say the least of it.

In this case, the space A between the first throat portion 4a and the second throat portion 4b presents the minimum volume for accomplishing the purpose as abovementioned. Therefore, the lower of the gas density on the tip of the smaller diameter portion is suppressed at a minimum, because the space A is immediately filled by the gas which passes through the gas inlet portion B.

The tip of the smaller diameter portion of the fixed contactor 11 shown in FIG. 6 is almost at the same position as the first throat portion 4a, while the cross-sectional area of the gas inlet portion B is greatly increased by locating the tip at the downstream side of the first throat portion 4a as shown with two dotted line in FIG. 6. In this case, the lower of the gas density on the smaller diameter portion 11a is suppressed at a minimum.

Also, in the insulating nozzle 4 of the puffer type circuit breaker shown in FIG. 7, the inner diameter of the nozzle 4 is made in such manner as to be equal nearly to the diameter $D_3$ of the larger diameter portion 11c of the fixed contactor 11 as shown in FIG. 6 continuously to the position adjacent to the projection 4c at the side of the second throat portion 4b in the space between the both throat portions 4a and 4b. And, in a recessed portion just adjacent to the first throat portion 4a in the downstream side of the gas flow, the surface is formed so as to deflect the blowing gas toward the tip of the fixed contactor 11.

In this case, the space A between the first throat portion 4a and the second throat portion 4b is immediately filled by the arc-extinguishing gas which passes through the gas inlet portion B, and then the lower of the gas density is suppressed at a minimum to improve the transient withstand voltage in the puffer type circuit breaker, because the arc-extinguishing gas is blowed to the tip of the smaller diameter portion 11a by the deflecting surface of the recessed portion.

In the above embodiments, although it is purposed to improve the breaking ability of small capacitive current, the breaker requires the breaking performance that it is used in case of a short-circuit current, for example 40 kiloamperes or 63 kiloamperes. It is possible to select the use of either the breaker shown in FIGS. 6 and 7 and used in the way that the ideal rated breaking current is 40 kiloamperes or the breaker shown in FIG. 5 and used in the way that the rated breaking current is above 50 kiloamperes.

In the insulating nozzle 4 used in the abovementioned embodiments, since the axial length of the nozzle 4 increases more than that of the conventional one, the nozzle may be made by mechanically combining two axially devided parts. In this case, the part which has the first throat portion 4a is made of the material superior to an arc resistance, for example a teflon or the teflon which improves the transient withstand voltage by inserting a filling therein etc. and the part which has the second throat portion 4b is made of the material inferior to the arc resistance and superior to the insulation, for example a teflon.

As abovementioned, in the puffer type circuit breaker according to the present invention, a fixed contactor have a larger diameter portion at the base side thereof and a smaller diameter portion formed at the tip thereof, thereby allowing the first throat portion formed at the upstream side of the blowing gas to be adjusted by the above smaller diameter portion and the second throat portion formed at the downstream side of the blowing gas to be adjusted by the above larger diameter portion. The diameters of the first throat portion and the smaller diameter portion have the relation of dimension between those so as to form a gas inlet portion, while the space between the second throat portion and the larger diameter portion have the relation of dimension so as to almost close the gap between those. When the second throat portion is closed by the larger diameter portion, the arc-extinguishing gas of high pressure is conducted into the chamber between the both throat portions through the gas inlet portion B. Accordingly, since the rapid gas flow is generated, it is possible to prevent the transient withstand voltage from being lowered by the reduction of the gas density on the tip of the fixed contactor.

What is claimed is:

1. A puffer type circuit breaker, comprising:

at least one set of a fixed contactor and a movable contactor separable from each other;

said fixed contactor having a larger diameter portion located on the base side thereof and a smaller diameter portion located on the tip side thereof;

a gas compressor for compressing a blowing gas for extinguishing an arc simultaneously with the separating operation of said both contactors;

an insulating nozzle for conducting the high pressure gas obtained from said gas compressor so as to blow into the space between said both contactors; and said insulating nozzle having a first throat portion located on the upstream side of said blowing gas and adjusted by said smaller diameter portion as a gas inlet portion is formed between said first throat portion and said smaller diameter portion, and a second throat portion located on the downstream side of said blowing gas and adjusted by said larger diameter portion, said second throat portion having such a relation of the diameter to said larger diameter portion that said second throat portion is substantially closed by said larger diameter portion.

2. A puffer type circuit breaker according to claim 1, wherein said fixed contactor has a gradually changing diameter portion between said smaller diameter portion and said larger diameter portion.

3. A puffer type circuit breaker according to claim 2, wherein the diameter difference between said first throat portion and said smaller diameter portion has such a dimension that a space between both said throat portions is communicated with said gas compressor when said fixed contactor is contacted with said movable contactor.

4. A puffer type circuit breaker according to claim 1, wherein the smaller diameter portion of said fixed throat portion has such a length that the tip of said smaller diameter portion reaches at least said first throat portion when said second throat portion is substantially closed by said larger diameter portion.

5. A puffer type circuit breaker according to claim 1, wherein said insulating nozzle has at least one surface, which is formed between both said contactors, for deflecting said blowing gas to the tip of said fixed contactor.

6. A puffer type circuit breaker according to claim 1, wherein a enlarged inner diameter portion just adjacent to said first throat portion is formed as said second throat portion and in such manner as to have the diameter substantially equalized to that of the larger diameter portion of said fixed contactor.

7. A puffer type circuit breaker according to claim 6, wherein a recessed portion having the surface for deflecting the blowing gas to the tip of said fixed contactor is formed on said enlarged inner diameter portion just adjacent to said first throat portion.

8. A puffer type circuit breaker according to claim 1, wherein said first throat portion has the cross-sectional area smaller than that of a gas passage formed between said smaller diameter portion and said second throat portion when said smaller diameter portion is located at said second throat portion.

* * * * *